United States Patent [19]

Nieppola

[11] Patent Number: 4,927,135

[45] Date of Patent: May 22, 1990

[54] EXERCISE APPARATUS

[76] Inventor: Heikki Nieppola, Rusinniementie 17, SF-35800 Mänttä , Finland

[21] Appl. No.: 246,397

[22] PCT Filed: Dec. 29, 1987

[86] PCT No.: PCT/FI87/00178

§ 371 Date: Sep. 2, 1988

§ 102(e) Date: Sep. 2, 1988

[87] PCT Pub. No.: WO88/04943

PCT Pub. Date: Jul. 14, 1988

[30] Foreign Application Priority Data

Jan. 5, 1987 [FI] Finland ..... 870017

[51] Int. Cl.[5] ..... A63B 17/00

[52] U.S. Cl. ..... 272/63; 272/112; 272/144; 182/95

[58] Field of Search ..... 272/62, 63, 112, 144, 272/103, 109, 113; 182/27, 95; 5/133, 136, 137; 108/11, 17

[56] References Cited

U.S. PATENT DOCUMENTS

| | | | |
|---|---|---|---|
| 316,643 | 4/1885 | Niehaus | 182/27 X |
| 513,012 | 1/1894 | Hall | 182/27 |
| 623,540 | 4/1899 | Hall | 182/27 X |
| 2,855,200 | 10/1958 | Blickman | 272/63 |
| 4,358,109 | 11/1982 | Schrems . | |
| 4,759,539 | 7/1988 | Nieppola | 272/63 |

FOREIGN PATENT DOCUMENTS

| | | | |
|---|---|---|---|
| 2020661 | 11/1971 | Fed. Rep. of Germany . | |
| 2556209 | 6/1977 | Fed. Rep. of Germany . | |
| 2641614 | 3/1978 | Fed. Rep. of Germany . | |
| 690032 | 9/1930 | France . | |
| 87/00065 | 1/1987 | PCT Int'l Appl. . | |
| 1211853 | 11/1970 | United Kingdom | 272/144 |

*Primary Examiner*—Stephen R. Crow

*Attorney, Agent, or Firm*—Pollock Vande Sande & Priddy

[57] ABSTRACT

Exercise apparatus having upper and lower elongated members connected end to end by a pivot joint and arranged to be mounted at a wall. Various arrangements of the two members are possible by devices for releasable locking the two members at the wall. In one arrangement both members are secured in a vertical plane against the wall. In other arrangements, either the upper member is pivoted away from the wall and held in a plane parallel to the floor by support at one end by the lower member and at the other end by a fixed pedestal, or both members are pivoted away from the wall, at least the upper end of the upper member being supported by the pedestal at its upper end.

6 Claims, 4 Drawing Sheets

EXERCISE APPARATUS

FIELD OF THE INVENTION

The present invention relates to an exercise apparatus, comprising a two-piece plane provided with a linkage for folding the pieces of the plane to an angle relative to each other. Such exercise apparatus further includes means for locking the plane in an upright position, for supporting the plane as a horizontal plane and for supporting the plane as an inclined plane.

BACKGROUND ART

The above type of exercise apparatus is known from U.S. Pat. No. 4,759,539 in the name of the present inventor. In this prior solution, the lower section of an exercise apparatus is provided with a linkage, which is fixed relative to the exercise apparatus and elevated from the floor and around which a two-piece plane is revolved in a vertical plane for bringing the exercise apparatus into a variety of functional positions. This prior solution set forth in the patent cited above is advantageous provided that there are no restrictions set, for example, by room height. In low-ceilinged premises like basements, due to the installation of a fixed linkage above the floor, the length of a two-piece plane cannot be made functionally sufficient.

SUMMARY OF THE INVENTION

An object of this invention is to provide an exercise apparatus, which is particularly suitable for low-ceilinged premises, for example, basement rooms, and whose exercise planes are sufficiently long even though room height may induce restrictions. In addition, an exercise apparatus of the invention has certain extra features compared to the prior art, and is an advantageous exercise apparatus.

In order to achieve this object, an exercise apparatus of the invention includes a fixed linkage in the lower section of an exercise apparatus which is adapted for mounting on a fixed base, such as a floor. The linkage of the two-piece plane is provided with locking means and the upper section of the exercise apparatus carries an extending member adapted to serve as a support pedestal.

This solution provides an exercise apparatus, the functional length of whose two-piece plane begins immediately at floor surface. By means of the linkage locking means of a two-piece plane the exercise apparatus can be set in positions suitable for various workout exercises, such as in a horizontal plane and in an inclined plane, whereby the latter, due to a possibility of locking the linkage, can even be set in at least two angular positions. The extending member in the upper section of the exercise apparatus serves as a support pedestal in all lowered positions of the exercise apparatus in a manner that the outermost portion of such extending member supports itself against the floor.

The invention will now be described in more detail with reference made to an embodiment shown in the accompanying drawings. In the drawings;

DETAILED DESCRIPTION OF THE PREFERRED EMBODIMENT(S)

Figure 1:
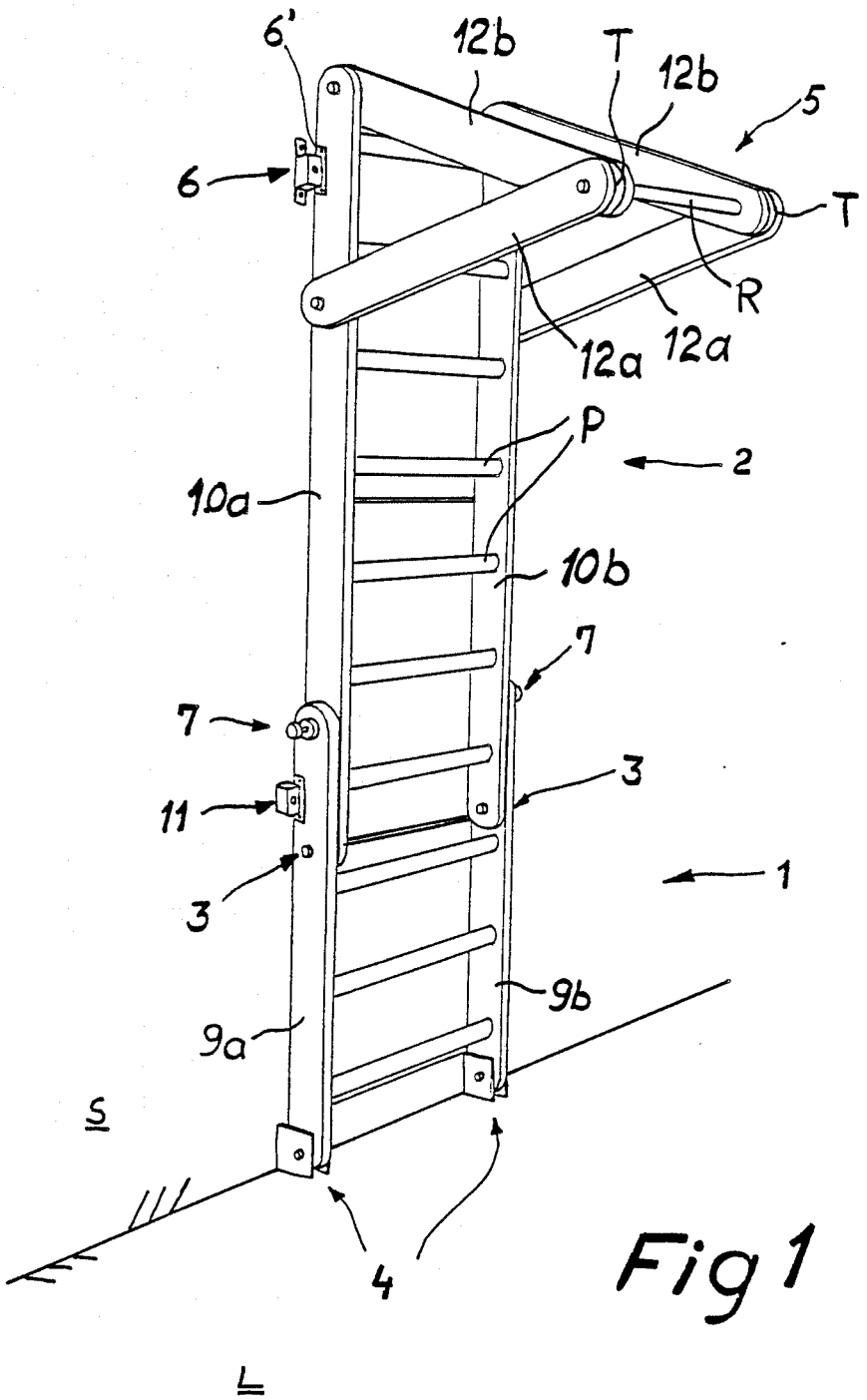
FIG. 1 is a perspective view of an exercise apparatus in an upright position.

As shown in the drawings, the exercise apparatus of the present invention can be used to perform a great variety of workout exercises as the exercise apparatus can be handily set in various positions. For example, when fastened to a wall S in an upright position shown in FIG. 1, the exercise apparatus provides so-called ladder rungs P and the additional feature for use this position is a horizontal bar R. From the position shown in FIG. 1 the upper piece 2 of a two-piece plane 1, 2 can be lowered onto a fixed horizontal base, such as a floor L, as shown in FIG. 2. Now, the upper piece of a two-piece plane provides a horizontal plane carried, on the one hand, by a linkage 3 of such two-piece plane and on the other hand by the floor L with the help of an extending member 5. Proceeding from the position of FIG. 1 to that of FIG. 2 is effected by removing the locking means of two clamps 6 secured to wall S from the upper plane section 2. Both clamps 6, mounted on either side of the upper plane section 2, include as a locking means a turnable metallic locking tongue which in a locking position is connected to the upper plane section 2, engaged in a corresponding groove 6'' in metal plates 6', the latter being fastened to the lateral faces of the stringers **10*a*, 10*b* of upper plane section 2**.

The linkage 3 of two-piece plane 1, 2 is provided with locking means 7 which must also be unlocked for setting an exercise apparatus in the position shown in FIG. 2. The locking means 7 comprises locking pins 7', which are mounted on the extensions of the longitudinal stringers **9*a*, 9*b* of a lower, first plane section 1 and which are on cooperation with holes 8 made in the longitudinal stringers 10*a*, 10*b* of an upper, second plane section 2. Stringers 9*a*, 9*b* are positioned so as lie on the outside of stringers 10*a*, 10*b* of the upper plane section 2 whenever the plane sections 1, 2 are parallel to each other. Thus, locking pins 7' can be inserted in holes 8 by manipulating a locking means operating button 7''**.

A fixed linkage 4 comprises two cross-sectionally U-shaped plates 4', between which are fitted the bottom parts of stringers **9*a* and 9*b* of lower plane section 1. Turning of the first plane section in the plane proceeds around horizontal pins 4'' fitted between members 4' and 9*a* (respectively 4' and 9*b*). Plates 4'** are fastened either to wall S and/or to floor L.

Figure 2:
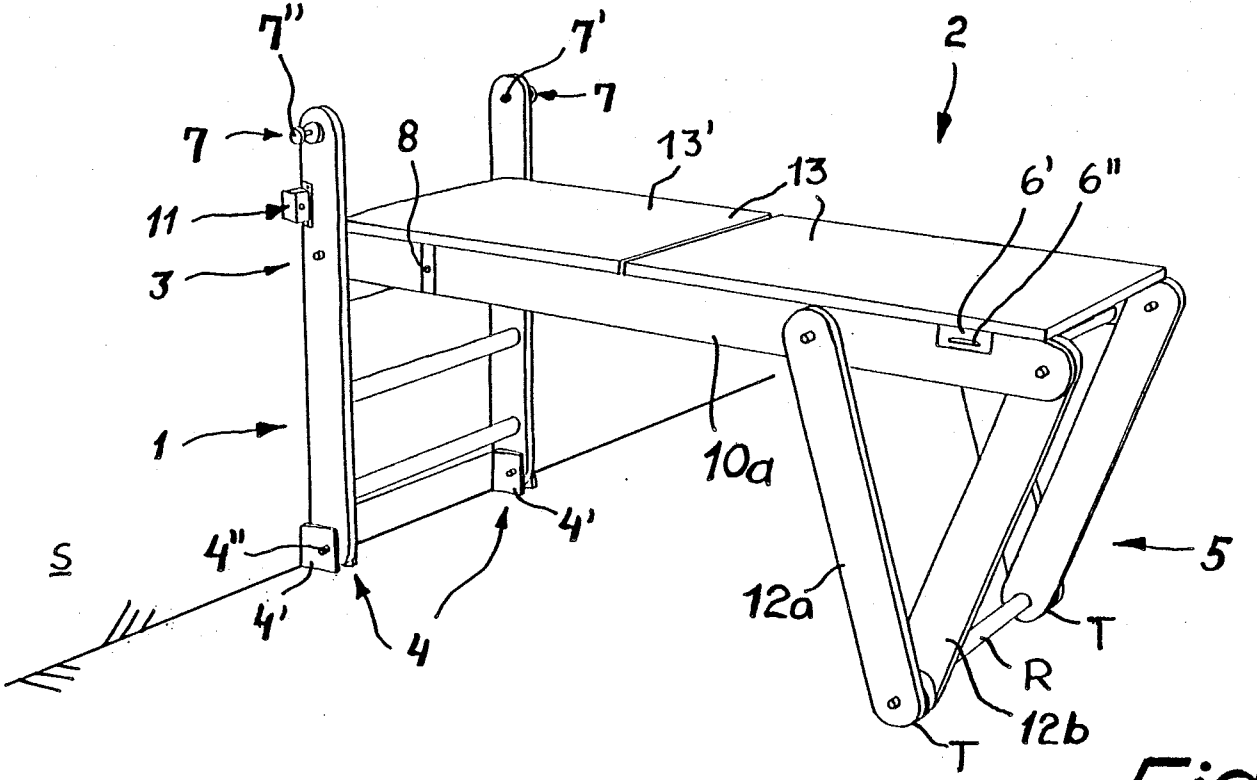
FIG. 2 is a perspective view of an exercise apparatus in a second position, the apparatus being fitted in a horizontal plane and to be used, for example, as a table top or for dorsal muscle workouts.

In the position shown in FIGS. 1 and 2, the lower plane section is further secured to wall S by means of two clamps 11 which structurally correspond to clamps 6.

Figure 3:
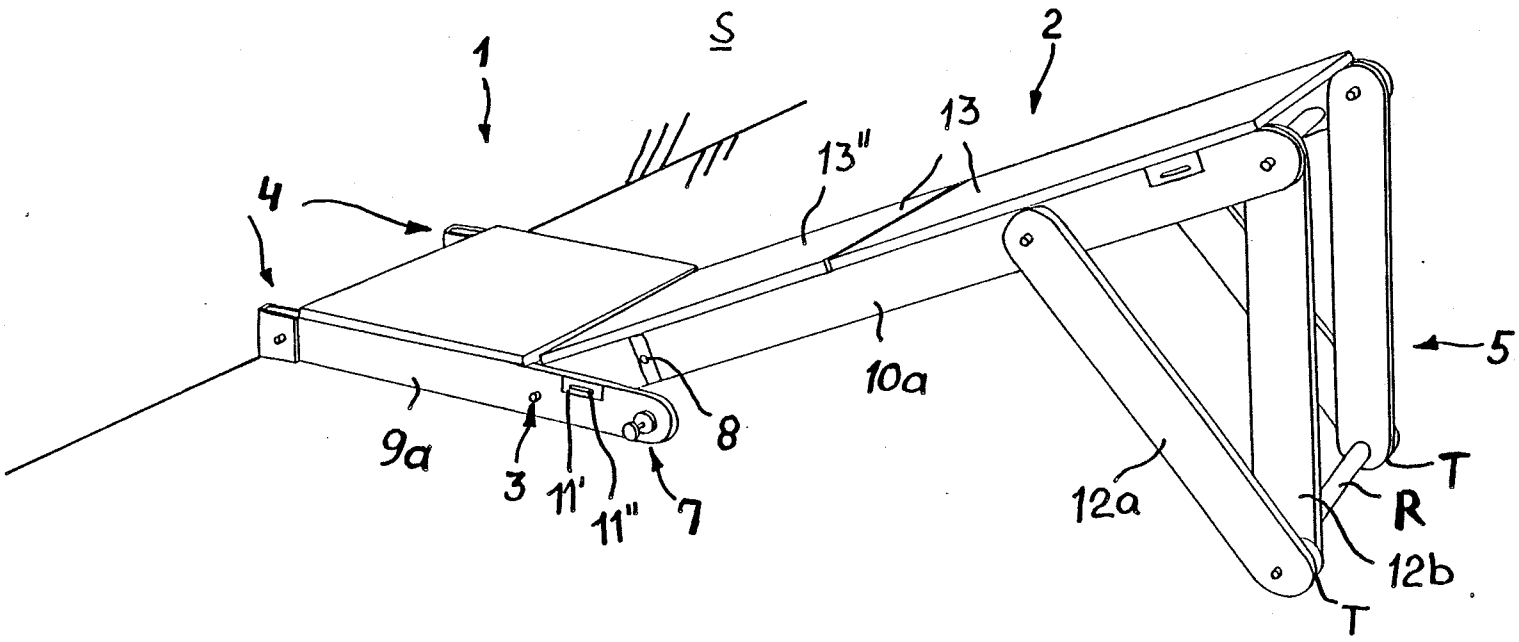
FIG. 3 is another perspective view of an exercise apparatus in its third position, which is at the same time a first position for using the exercise apparatus as an inclined plane.
Figure 4:
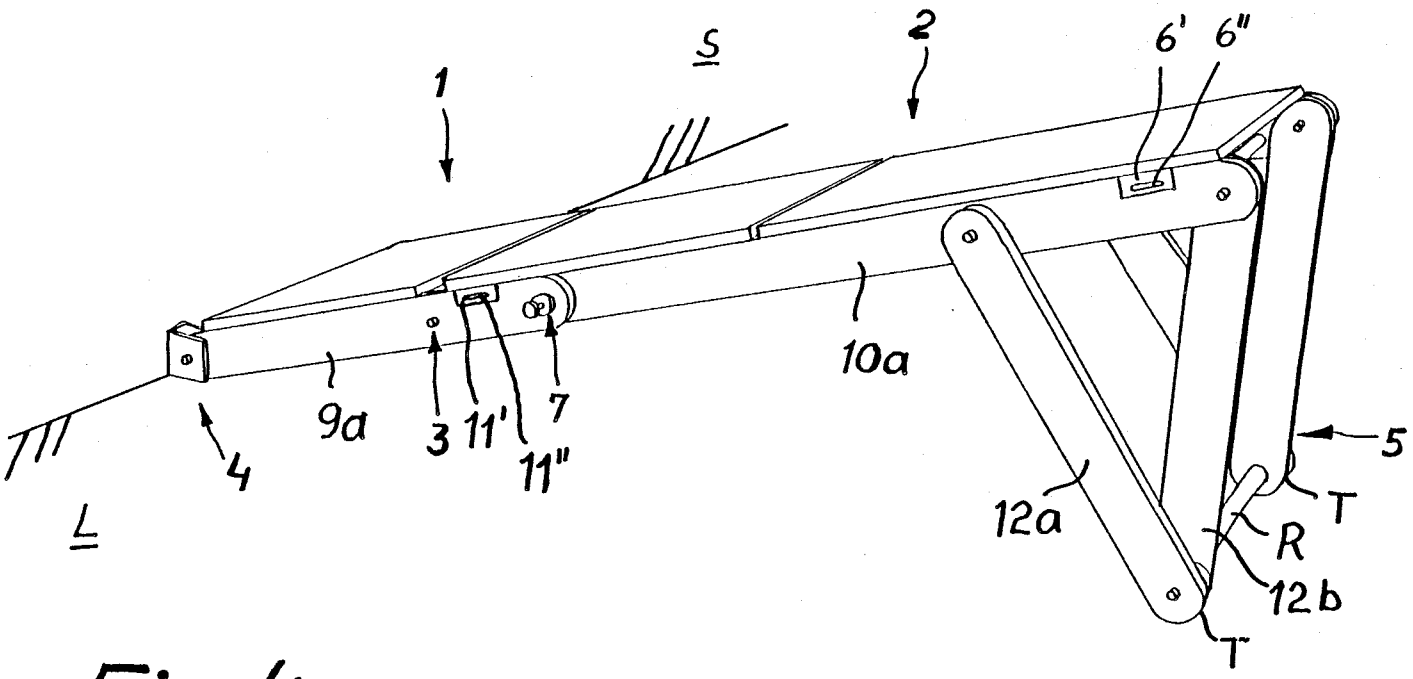
FIG. 4 is also a perspective view of an exercise apparatus in a fourth position, which is a second position for using the exercise apparatus as an inclined plane which, similarly to the position of FIG. 3, is intended for abdominal muscle workouts.

Each clamp 11 acts on a corresponding groove 11'' in metal plates 11' mounted on the lateral faces of stringers **9*a* and 9*b* of lower plane section 1. When a respective locking tongue of the above-mentioned clamps 11 is unlocked, the position of FIG. 3 is reached from that of FIG. 2, the lower plane section 1 turning to extend parallel to floor L around linkage 4 supporting itself against the floor at stringers 9***a*, 9*b* and the upper plane section 2 is set by means of extending member 5 in an inclined plane that can be used for abdominal muscle workouts. If the two-section or two-piece plane 1, 2 is clamped by locking means 7 in a parallel position, there will be provided a continuous inclined plane shown in FIG. 4, the linkage 3 of two-piece plane 1, 2 being elevated from the floor where it was lying in a flat position, shown in FIG. 3.

The extending member 5 consists of two pairs of stringers 12*a*, 12*b* secured to the longitudinal stringers 10*a*, 10*b* of upper plane section 2 at the top thereof. Stringers 12*a*, 12*b* are set in an inclined position so as to join each other at the free ends thereof. The pairs of stringers are linked by a horizontal bar R. The distance of a fulcrum T in the pairs of stringers from the surface of upper plane section 2 corresponds to the distance between linkages 3 and 4.

The top plate 13 of upper plane section 2 is a two-piece element, the lower piece 13' being removable for alternative series of workouts. The apparatus is naturally also provided with a necessary foot strap (not shown) for securing the feet of a user during workout movements.

I claim:

1. Exercise apparatus for use mounted at a wall, said apparatus comprising:

upper and lower elongated members, each of said elongated members comprising a pair of spaced-apart longitudinal stringers and means holding said stringers in a spaced-apart parallel arrangement, each of said members having upper and lower end portions;

means affixed at the lower end of said lower member for pivotally securing said lower member at the base of said wall;

pivot means connecting the lower end portion of said upper member in an overlapping relationship with the upper end portion of said lower member for pivoting movement between a position in which both elongated members are in the same plane, and a position in which said elongated members are at an angle with respect to each other;

locking means for locking said elongated members in the same plane in an upright position, and for securing said upper elongated member in a horizontal or an inclined position, said locking means comprising pins mounted at the upper ends of said stringers of said lower elongated member and corresponding holes in the lower end portion of said upper elongated member for engaging said pins; and a support pedestal fixedly mounted on the upper end of said upper elongated member for supporting said upper end of said upper elongated member.

2. Exercise apparatus for use mounted at a wall, said apparatus comprising:

upper and lower elongated members, each of said elongated members comprising a pair of spaced-apart longitudinal stringers and means holding said stringers in a spaced-apart, parallel arrangement, each of said members having upper and lower end portions;

means affixed at the lower end of said lower member for pivotally securing said lower member at the base of said wall;

pivot means connecting the lower end portion of said upper member in an overlapping relationship with the upper end portion of said lower member for pivoting movement between a position in which both elongated members are in the same plane, and a position in which said elongated members are at an angle with respect to each other;

locking means in the upper end portions of each of said elongated members, said locking means cooperating with means mounted on said wall for locking both of said elongated members in an upright position, for supporting said upper elongated member in a horizontal plane by releasing the locking means of said upper elongated member, and for supporting said upper elongated member as an inclined plane by releasing said locking means of said upper and lower elongated members; and a support pedestal fixedly mounted on the upper end of said upper elongated member for supporting said upper end when said upper elongated member is in a horizontal or an inclined position.

3. Exercise apparatus according to claim 2, wherein said means for holding said stringers in a parallel, spaced-apart relationship comprises a plurality of parallel, spaced-apart rung elements secured to and extending between said stringers.

4. Exercise apparatus according to claim 2, wherein said locking means includes pins mounted at the upper ends of said stringers of said lower elongated member and holes in the lower end portion of said upper elongated member adapted to receive said pins for retaining said upper and lower elongated members in the same plane.

5. Exercise apparatus according to claim 4, wherein the stringers for said lower elongated member are positioned on the outside of the stringers for said upper elongated member.

6. Exercise apparatus according to claim 2, wherein said means mounted on said wall includes clamps secured to said wall adjacent the upper end portions of said upper and lower elongated members for releasably securing said elongated members at said wall.

* * * * *